US008155573B2

(12) United States Patent
Sone et al.

(10) Patent No.: US 8,155,573 B2
(45) **Date of Patent: *Apr. 10, 2012**

(54) IMAGE FORMING APPARATUS AND FUSER APPARATUS

(75) Inventors: Toshihiro Sone, Kanagawa-ken (JP); Kazuhiko Kikuchi, Kanagawa-ken (JP); Satoshi Kinouchi, Tokyo-to (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/174,865

(22) Filed: Jul. 1, 2011

(65) Prior Publication Data

US 2011/0262194 A1 Oct. 27, 2011

Related U.S. Application Data

(63) Continuation of application No. 12/619,727, filed on Nov. 17, 2009, now Pat. No. 7,995,957.

(60) Provisional application No. 61/115,205, filed on Nov. 17, 2008.

(51) Int. Cl.
*G03G 15/20* (2006.01)

(52) U.S. Cl. ..... 399/329; 219/216; 399/330

(58) Field of Classification Search ..... 399/328, 399/329, 330, 333; 219/216; 492/46; 430/124.3, 430/124.31

See application file for complete search history.

(56) References Cited

U.S. PATENT DOCUMENTS

| | | | |
|---|---|---|---|
| 6,853,833 | B2 | 2/2005 | Cho et al. |
| 2006/0056888 | A1 | 3/2006 | Sugiyama et al. |
| 2007/0059062 | A1 | 3/2007 | Endo et al. |
| 2007/0166069 | A1 | 7/2007 | Chang et al. |
| 2009/0232535 | A1 | 9/2009 | Tsueda et al. |

FOREIGN PATENT DOCUMENTS

| | | |
|---|---|---|
| JP | 2004-077683 | 3/2004 |
| JP | 2007-025280 | 2/2007 |
| JP | 2007-108690 | 4/2007 |

OTHER PUBLICATIONS

U.S. Office Action dated Nov. 16, 2010 corresponding to U.S. Appl. No. 12/619,727, filed Nov. 17, 2009.

*Primary Examiner* — Sophia S Chen
(74) *Attorney, Agent, or Firm* — Turocy & Watson, LLP

(57) ABSTRACT

According to an embodiment of the invention, a heat uniforming member, which has an outer diameter smaller than an inner diameter of a hollow member and in which thermal deformation generated by thermal expansion remains, is set in the inside of the hollow member having a center axis, support members are set to both ends of the hollow member to enable supporting of ends of the heat uniforming member, and an endless body having a uniform thermal distribution is formed by heating the hollow member, the heat uniforming member and the support member at a specified temperature for a specific time and causing the heat uniforming member to adhere closely to an inner wall of the hollow member.

10 Claims, 4 Drawing Sheets

IMAGE FORMING APPARATUS AND FUSER APPARATUS

CROSS-REFERENCE TO RELATED APPLICATIONS

This application is a Continuation of application Ser. No. 12/619,727 filed Nov. 17, 2009, the entire contents of which are hereby incorporated herein by reference.

This application is based upon and claims the benefit of priority from U.S. Provisional Application No. 61/115,205, filed on Nov. 17, 2008, the entire contents of which are incorporated herein by reference.

TECHNICAL FILED

The present invention relates to a fuser apparatus of an image forming apparatus and a fixing member.

BACKGROUND

In an MFP (image forming apparatus called a Multi-Functional Peripheral), a system using a thermal fusion toner as a developer to visualize an image is well known as an electrophotographic system.

In the MFP of the electrophotographic system, a latent image is visualized by a visualizing material called a toner. In the electrophotographic system, the toner is transferred to a sheet material.

The toner positioned on the sheet material remains on the sheet material by pressure and heat provided by a fuser apparatus, and a part thereof is united with the sheet material.

With respect to the fuser apparatus, a structure is widely used in which two rollers are disposed so that rotation axes of both are in parallel to each other, a specified pressure is applied between both, and specified heat is provided from at least one of the rollers. One of or both of the rollers may be substituted by an endless belt.

The toner remaining on the sheet material is melted by the heat when the sheet material moves through a fixing area between the rollers (area where both are in contact with each other in a direction orthogonal to the rotation axis), and a part thereof is united with the sheet material.

With respect to the longitudinal direction of the roller (direction in which the rotation axis extends), there is known that uneven temperature occurs dependently on the size of the sheet material (size of the image formed of the toner). From the background as stated above, there are many proposals for eliminating the uneven temperature.

For example, JP-A-2007-25280 (document 1) discloses that a heat pipe member for uniforming temperature is pressed to a pressure roller at a time of fixing operation of a small size sheet.

JP-A-2004-77683 (document 2) discloses that a heat pipe is brought into contact with the surface of a pressure roller, the heat of a roller end conducted from a heat roller is thermally transported by the heat pipe, and the temperature of the surface layer of the pressure roller is made uniform.

JP-A-2007-108690 (document 3) discloses a structure in which a roller including a heat pipe inserted in a hollow roller made of thin iron is used, and a flange part covers.

The document 1 and the document 2 merely disclose that the heat pipe contacts with the roller of a fuser apparatus from the outside and uniforms the temperature distribution. That is, it is not assumed that the heat pipe is incorporated in the inside of the roller.

Although the document 3 discloses that the heat pipe is positioned in the inside of the hollow roller, aligning (longitudinal direction) between the heat pipe and the roller is not discussed. Besides, the inclination and eccentricity of the heat pipe in the roller are not discussed.

SUMMARY

An object of the invention is to uniform a temperature distribution occurring in a fuser apparatus of an image forming apparatus using a visualizing agent fixed by heat.

Another object of the invention is to provide a structure capable of suppressing the occurrence of a temperature distribution which can occur in a fuser apparatus of an image forming apparatus using a visualizing agent fixed by heat.

According to an aspect of the present invention, there is provided a fuser apparatus comprising: a first endless body which is heated by a heat mechanism and keeps a temperature obtained by heating; a second endless body which fixes a visualizing agent supported by a sheet material to the sheet material in cooperation with the first endless body; a heat uniforming member positioned at a specified inside position of the first endless body; and a support member which supports the first endless body and sets a position of the heat uniforming member in a longitudinal direction of the first endless member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Hereinafter, an embodiment of the present invention is explained in detail below with reference to the accompanying drawings.

Figure 1:
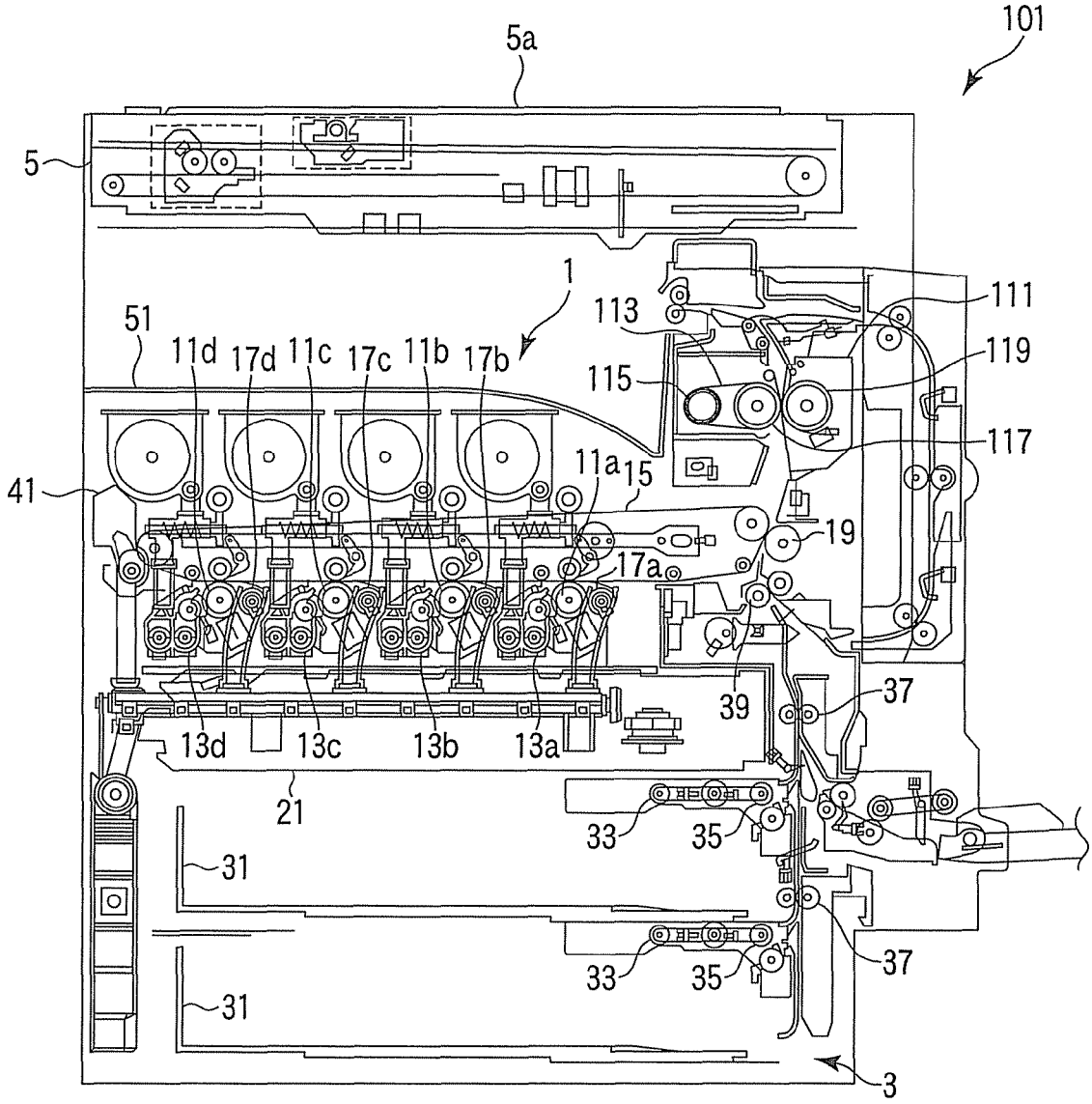
FIG. 1 shows an example of an image forming apparatus (Multi-Functional Peripheral (MFP)) to which an embodiment of the invention is applied.

FIG. 1 shows an outline of an image forming apparatus (MFP, Multi-Functional Peripheral) to which the invention can be applied.

An image forming apparatus 101 shown in FIG. 1 includes an image forming section main body 1 to output image information as "image output" called "hard copy" or "print out" in a state where a toner image is fixed to a sheet material, a sheet supply section 3 capable of supplying a sheet (sheet material) of an arbitrary size used for the image output to the image forming section main body 1, and an image reading section 5 to capture, as image data, image information as an object of image formation in the image forming section main body 1 from a read object (hereinafter referred to as a document) holding the image information.

Although not described in detail, the image reading section 5 includes a document table (document glass) 5*a* to support a document, and an image sensor, such as a COD sensor, to convert the image information into the image data. The image reading section 5 converts reflected light obtained by irradiating illumination light from an illumination device, of which description is omitted, to a document set on the document table 5*a* into an image signal by the CCD sensor.

The image forming section main body 1 includes first to fourth photoconductive drums 11*a* to 11*d* to hold latent images, developing devices 13*a* to 13*d* to supply developing agents, that is, toners to the latent images held by the photoconductive drums 11*a* to 11*d* to develop them, a transfer belt 15 to hold toner images held by the photoconductive drums 11*a* to 11*d* in sequence, first to fourth cleaners 17*a* to 17*d* to remove toners remaining on the photoconductive drums 11*a* to 11*d* from the respective photoconductive drums 11*a* to 11*d*, a transfer device 19 to transfer the toner image held by the transfer belt 15 to a sheet material, that is, a sheet-like material such as a standard paper or an OHP sheet as a transparent resin sheet, a fuser unit 111 to fix the toner image to the sheet material to which the toner image is transferred, an exposure device 21 to form the latent images on the photoconductive drums 11*a* to 11*d*, and the like.

The first to the fourth developing devices 13*a* to 13*d* contain arbitrary color toners of Y (yellow), M (magenta), C (cyan) and Bk (black) used for obtaining a color image by a subtractive process, and visualize the latent images held by the respective photoconductive drums 11*a* to 11*d* with toners of colors of Y, M, C and Bk. The order of the respective colors is determined to be a specified order according to an image formation process or characteristics of the toner.

The transfer belt 15 holds the toner images of the respective colors formed by the first to the fourth photoconductive drums 11*a* to 11*d* and the corresponding developing devices 13*a* to 13*d* in the order of formation of the toner images.

The sheet supply section 3 supplies the sheet material to which the toner image is transferred to the transfer device 19 at a specified timing.

Cassettes, the details of which are not described, positioned in plural cassette slots 31 contain sheet materials of arbitrary sizes. According to an image formation operation not described in detail, a pickup roller 33 takes out a sheet material from a corresponding cassette. The size of the sheet material corresponds to the magnification requested at the image formation and the size of the toner image formed by the image forming section main body 1.

A separation mechanism 35 prevents two or more sheet materials from being taken out from the cassette by the pickup roller 33.

Plural conveyance rollers 37 convey one sheet material separated by the separating mechanism 35 to an aligning roller 39.

In timing with transfer of the toner image from the transfer belt 15 by the transfer device 19, the aligning roller 39 sends the sheet material to a transfer position where the transfer device 19 contacts with the transfer belt 15.

The fuser unit 111 fixes the toner image corresponding to image information to the sheet material, and sends it as an image output (hard copy, print out) to a stock section 51 positioned in a space between the image reading section 5 and the image forming section main body 1.

The transfer belt 15 holds toner (hereinafter referred to as waste toner) remaining on the transfer belt 15, and moves the waste toner to a specified position in accordance with the movement of the belt surface thereof. A belt cleaner 41 contacts with the transfer belt 15 for moving the waste toner at a specified position and removes the waste toner held on the belt surface of the transfer belt 15 from the transfer belt 15.

Figure 2:
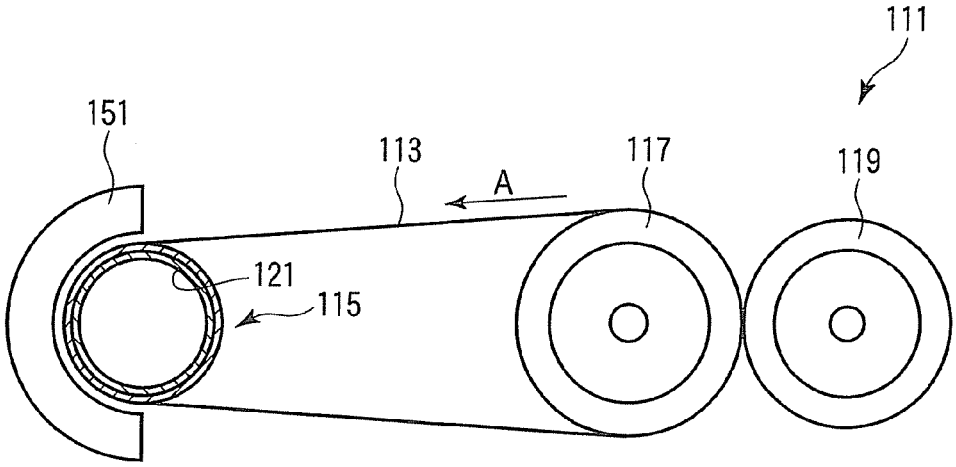
FIG. 2 shows a state (sectional view) in which a fuser apparatus of the image forming apparatus shown in FIG. 1 is extracted and is cut along a plane orthogonal to a rotation axis.

FIG. 2 shows a state (sectional view) in which the fuser apparatus included in the image forming apparatus (MFP) shown in FIG. 1 is extracted and is cut along a plane orthogonal to a rotation axis.

The fuser unit 111 includes an endless belt 113, a first roller 115 rotating to enable a surface of the endless belt 113 to move in an arrow A direction, a second roller 117 to impart a specified tension to the endless belt 113 in cooperation with the first roller 115, and a third roller 119 to give a specified pressure to the second roller 117 at a position where the endless belt 113 intervenes between the third roller and the second roller 117. The first roller 115 receives a specified pressure from the second roller 117 by a pressure member or pressure mechanism, for example, a spring 151 in order to impart the specified tension to the endless belt 113.

An induction coil, not described in detail, of an induction heating device 151 as a heat source is positioned at the outer periphery of the first roller 115. Accordingly, the endless belt 113 receives the heat generated by the first roller 115 while an arbitrary position is moved by the rotation of the first roller 115.

The endless belt 113 includes a sheet (belt) in which the surface of a resin film having a heat resistance up to at least 250.degree. C. and a specified thickness or a metal thin film subjected to an insulation process is coated with ethylene tetrafluoride resin well-known as Teflon (trade mark) to ensure a certain peeling property and smoothness.

Each of the first, the second and the third rollers may be hollow. The rotation axis (rotation center) of the second roller 117 and the rotation axis (rotation center) of the third roller 119 are positioned substantially in parallel to each other. The second roller 117 and the third roller 119 receive a specified pressure mutually between the rotation axes (rotation centers) of both (the second roller 117 and the third roller 119 mutually provide the specified pressure to the opposite rotation axis (rotation center)).

The toner remaining on the sheet material and the sheet material on which the toner remains pass through a fixing area (nip) where the endless belt 113 contacts with the third roller 119. The toner remaining on the sheet material moves while facing the endless belt 113.

The peeling property and smoothing property of the surface of the first roller 115 is raised by a tube using a thermoplastic fluorine resin, for example, a copolymer of perfluoroalkoxy ethylene and ethylene tetrafluoride (PFA). Other than the PFA tube, a coating of DLC (Diamond Like Carbon) can also be used.

The first roller 115 is hollow, that is, has a pipe shape (thin metal pipe) in which the inside is hollow. The material is, for example, iron. The first roller 115 may be made of stainless steel or Al (aluminum). It is preferable that the thickness of the first roller 115 is 0.3 mm or more when the material is iron (or stainless steel).

The first roller 115 includes a heat uniforming member, that is, a heat pipe 121.

The heat pipe 121 is made of a material having a high thermal conductivity, for example, Al (aluminum) or alloy containing Al. The materials of the heat pipe 121 and the first roller 115 are selected so that the thermal conductivity of the heat pipe 121 becomes the thermal conductivity of the heat pipe>the thermal conductivity of the first roller.

Incidentally, with respect to a coefficient of thermal expansion, the coefficient of thermal expansion of the heat pipe>the coefficient of thermal expansion of the first roller.

Besides, the first roller 115 has such strength (which is set according to the combination of physical properties and viscosities of the materials, thicknesses, and the like) that after the heat pipe 121 is expanded in the inside, the outer diameter does not change.

Figure 3A:
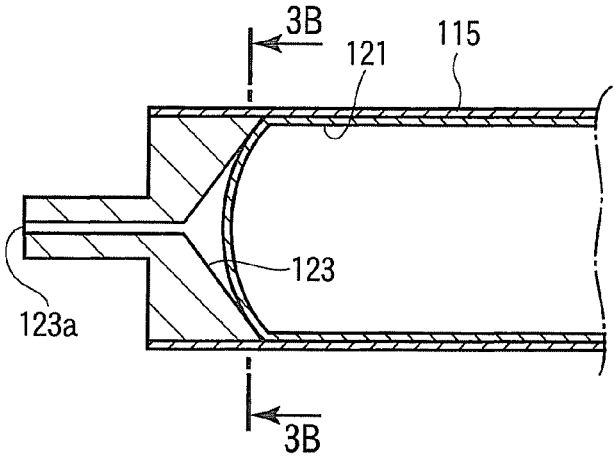
FIG. 3A shows a state (sectional view) in which a first roller included in the fuser apparatus shown in FIG. 2 is cut along the rotation axis (rotation center)

Although an example is shown in FIG. 3A, each of both ends of the heat pipe 121 has a shape similar to a cone shape, a spherical shape or a shape obtained by rotating a parabola, and the heat pipe has a pipe shape hermetically-sealed by, for example, welding. Each of the shapes of both the ends may be a cone shape.

The heat pipe 121 has, for example, an outer diameter of 15.88 mm, and a thickness of about 0.6 mm. The outer diameter of the heat pipe 121 is smaller than the inner diameter of the first roller 115 by 0.5 to 1 mm in radius. The outer diameter of the heat pipe 121 is arbitrarily set based on the outer diameter of the first roller 115.

The heat pipe 121 is positioned at a specified position of the inside of the first roller 115 by a method in which heat deformation generated by thermal expansion remains (method including a heat process similar to shrinkage fir or shrinking fit). For fixing, a bearing (stopper) 123 having a cone taper-shaped or a polygon-shaped concave part in which the rotation axis (rotation center) of the first roller 115 is a minimum diameter part is positioned at both ends of the first roller 115. Incidentally, the outer diameter of the heat pipe 121 brought into press contact with the inner wall of the first roller 115 does not return to the original outer diameter by thermal stress and thermal strain also at the time point when the temperature is returned to room temperature.

Figure 3B:
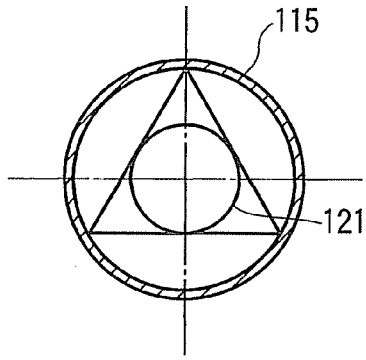
FIG. 3B shows a state (sectional view) in which the first roller included in the fuser apparatus shown in FIG. 3A is cut at a bearing connection part.
Figure 6A:
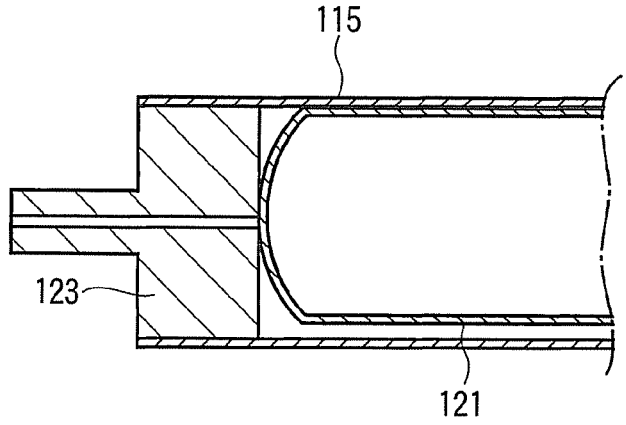
FIGS. 6A to 6C are schematic views showing ununiformity between a heat pipe and a roller body at the time of connection, which occurs when the structures of FIGS. 3A, 4 and 5 are not applied to the fuser apparatus shown in FIG. 2.
Figure 6B:
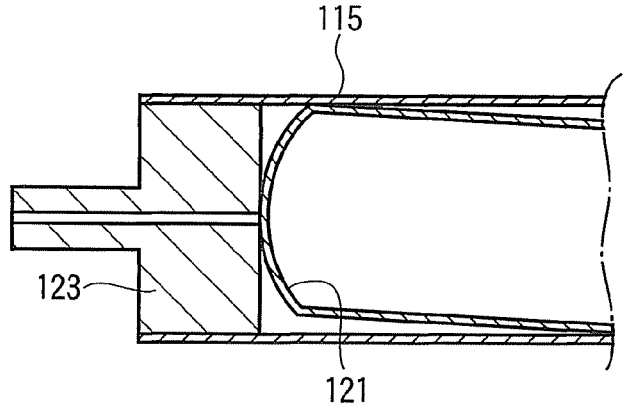
Figure 6C:
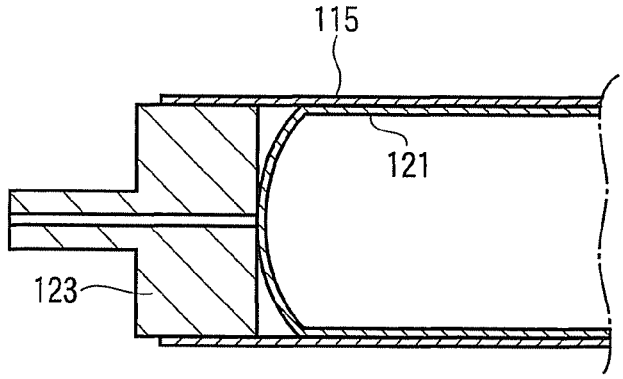

The bearing 123 includes a decompression hole (center opening) 123*a* to prevent the bearing 123 from jumping out from the first roller 115. The concave part of the bearing 123 shown in FIG. 3A preferably has a triangular pyramid shape (see FIG. 3B). Accordingly, the heat pipe 121 contacts with the concave part of the bearing 123 at three points. This structure stably supports the heat pipe 121. That is, the heat pipe 121 is positioned at substantially the center of the first roller 115 in the longitudinal direction in accordance with the inclination (taper of three planes of the triangular pyramid) of the bearing 123. Accordingly, it is possible to prevent the occurrence of eccentricity of the heat pipe 121 in the first roller 115 shown in FIG. 6A, inclination of the heat pipe 121 in the first roller 115 shown in FIG. 6B, and/or jumping-out of the bearing 123 from the first roller 115 shown in FIG. 6C.

Incidentally, as the material of the bearing 123, although stainless steel is suitable, inexpensive iron can also be used. When iron is used, it is preferable to perform countermeasures against sliding deterioration of the surface, for example, reduction of a friction coefficient, or addition of a slide member (coat of resin used for slide bearing). With respect to surface protection, a specific protection process is not specified.

In other words, when the heat pipe 121 is uniformly expanded in the first roller 115, uniform pressure is provided to the inner wall of the first roller 115. On the other hand, when the heat pipe is expanded in an inclined state or an eccentric state, the heat pipe 121 can not provide uniform pressure to the inner wall of the first roller 115. This causes irregularity in thermal transport properties of the heat pipe 121. Besides, when the degree of thermal expansion, that is, the pressure generated in the inside of the heat pipe 121 at the time of heating is high, under the condition that the heat pipe 121 does not rupture, it can be expected that the heat pipe 121 uniformly contacts with the inner wall of the first roller 115, and it is recognized that the temperature of the surface of the first roller 115 becomes uniform.

Incidentally, the thermal conductivity of the bearing 123 is lower than the thermal conductivity of the first roller 115. Accordingly, the thermal conductivity of the heat pipe>the thermal conductivity of the bearing.

Besides, the bearing 123, the first roller 115, and the heat pipe 121 are different from each other in material.

The heat pipe 121 is adhered closely to the inside of the first roller 115 by a method in which thermal deformation generated by thermal expansion remains.

In detail, the heat pipe is inserted in the first roller 115 by using a gap as a difference between the inner diameter of the first roller 115 and the outer diameter of the heat pipe 121, both ends are supported by the bearings 123, and heating is performed in the state where the position in the longitudinal direction of the first roller 115 is set, so that the heat pipe 121 is expanded and adheres closely to the inside of the first roller 15 along the inner diameter of the first roller 115. Incidentally, it is needless to say that before heating, the heat pipe 121 can slightly move in the first roller 115 along an axis of the first roller 115.

In more detail, the close adhesion of the heat pipe 121 to the inside of the first roller 115 can be realized by metal junction by heating at 300 to 400° C. for 1 to 4 hours. Incidentally, before the heating, the first roller 115 and the bearing 123 (both ends) are previously connected to each other by precise press fitting with a press fitting torque of, for example, 50 N/mm. Of course, the press fitting torque can be arbitrarily set under the condition that the bearing 123 does not detach from the first roller 115 by the thermal deformation of the heat pipe 121. Besides, since a friction pressure welding effect occurs at the contact point of the bearing 123 and the heat pipe 121 by the thermal deformation of the heat pipe 121, the priority of the management value of the press fitting torque is low.

Figure 4:
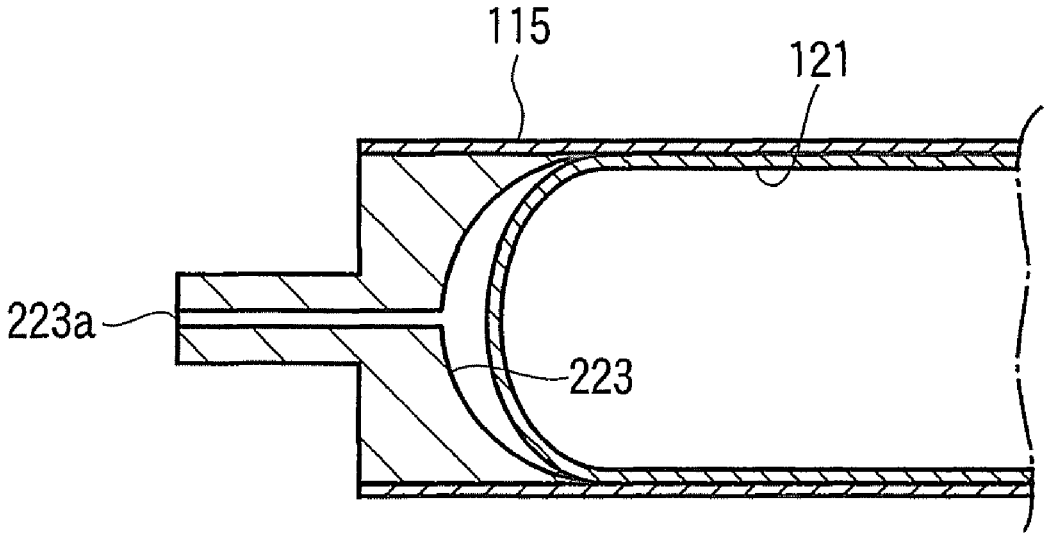
FIG. 4 shows a state (sectional view) in which the first roller included in the fuser apparatus shown in FIG. 2 is cut along the rotation axis (rotation center)

Incidentally, as shown in FIG. 4, a bearing (stopper) 223 with a hole 223*a*, denoted by 223 to distinguish it from that of FIG. 3A, uses the feature of the shape of the heat pipe 121 described in FIG. 3A, and may have a curved surface defined by rotating, for example, a parabola, in which the rotation axis (rotation center) of the first roller 115 can be made coincident with the center axis of the heat pipe 121.

Figure 5:
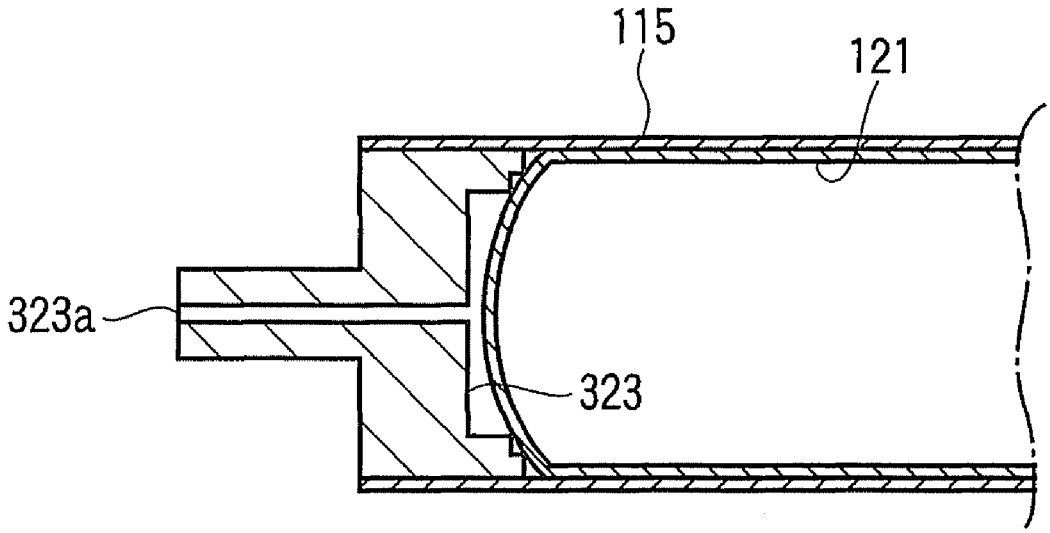
FIG. 5 shows a state (sectional view) in which the first roller included in the fuser apparatus shown in FIG. 2 is cut along the rotation axis (rotation center)

Besides, as shown in FIG. 5, a bearing (stopper) 323 with a hole 323*a*, denoted by 323 to distinguish it from that of FIG. 3A, uses the feature of the shape of the heat pipe 121 described in FIG. 3A, and may have, for example, two or more concentric steps in which the rotation axis (rotation center) of the first roller 115 can be made coincident with the center axis of the heat pipe 121.

As described above, in the fuser apparatus to which the embodiment of the invention is applied, the heat pipe having the high thermal transport speed (thermal transport property) can be adhered uniformly and closely to the inside of the roller body which raises the temperature of the endless belt to heat the toner as the visualizing agent up to the melting point (temperature). By this, the surface temperature of the roller body can be made uniform. When the toner is fixed to the sheet material having a short length (width), for example, A4-R, A5 or B4, as compared with the length of the roller body in the length direction (roller width), it is possible to prevent the temperature of a portion of the roller body, which does not contact with the sheet material, from varying undesirably.

Besides, at the time of warm-up, the temperature of the roller body can be uniformly raised (temperature rising). Especially, since it is possible to substantially prevent the temperature of a part of the roller body in the longitudinal direction from rising, the rising efficiency at the time of warm-up is improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fuser comprising:

a first endless body which is heated by a heat mechanism;

a second endless body which fixes a visualizing agent supported by a sheet material to the sheet material in cooperation with the first endless body;

a heat uniforming member positioned at a specified inside position of the first endless body; and a support member, including an axis and having a shape which holds the heat uniforming member such that curvature surfaces of both ends of the heat uniforming member are substantially concentric with a center of the first endless body, which supports the first endless body and sets a position of the heat uniforming member in a longitudinal direction of inside of the first endless body.

2. The fuser of claim 1, wherein the heat uniforming member adheres closely to an inner wall of the first endless body by thermal deformation.

3. The fuser of claim 2, wherein a concave part of the support member has a triangular pyramid shape.

4. The fuser of claim 1, wherein the support member includes a cone taper-shaped or a polygon-shaped concave part in which a rotation axis of the first endless body is a minimum diameter part.

5. The fuser of claim 1, wherein the support member includes concentric steps in which a rotation axis of the first endless body.

6. An image forming apparatus comprising:

a photosensitive member which holds a latent image;

a developing member which develops the latent image with toner;

a transferring member which transfers the toner image developed by the developing member to a sheet material; and a fuser which fixes the toner image to the sheet material thereon, the fuser includes:

a first endless body which is heated by a heat mechanism;

a second endless body which fixes the toner image supported by the sheet material to the sheet material in cooperation with the first endless body;

a heat uniforming member positioned at a specified inside position of the first endless body; and a support member, including an axis and having a shape which holds the heat uniforming member such that curvature surfaces of both ends of the heat uniforming member are substantially concentric with a center of the first endless body, which supports the first endless body and sets a position of the heat uniforming member in a longitudinal direction of inside of the first endless body.

7. The apparatus of claim 6, wherein the heat uniforming member adheres closely to an inner wall of the first endless body by thermal deformation.

8. The apparatus of claim 7, wherein a concave part of the support member has a triangular pyramid shape.

9. The apparatus of claim 6, wherein the support member includes a cone taper-shaped or a polygon-shaped concave part in which a rotation axis of the first endless body is a minimum diameter part.

10. The apparatus of claim 6, wherein the support member includes concentric steps in which a rotation axis of the first endless body.

* * * * *